United States Patent [19]

Büsselmann et al.

[11] Patent Number: 4,662,424

[45] Date of Patent: May 5, 1987

[54] MOTOR-VEHICLE WINDOW CURTAIN OPENING AND CLOSING MECHANISM

[75] Inventors: Manfred H. Büsselmann; Hans R. Gaffal, both of Munich, Fed. Rep. of Germany

[73] Assignee: Ultrafin AG, Fed. Rep. of Germany

[21] Appl. No.: 812,446

[22] Filed: Dec. 23, 1985

[51] Int. Cl.[4] ..... A47H 1/00

[52] U.S. Cl. ..... 160/331; 160/346

[58] Field of Search ..... 160/331, 340, 341, 344, 160/345, 346, 347, DIG. 2, DIG. 3; 296/138, 143, 145

[56] References Cited

U.S. PATENT DOCUMENTS 2,761,150 9/1956 Kellogg ..... 160/341 X 3,016,951 1/1962 Greene ..... 160/346 X

FOREIGN PATENT DOCUMENTS 3407664 9/1985 Fed. Rep. of Germany .

*Primary Examiner*—Robert W. Gibson, Jr.

*Attorney, Agent, or Firm*—Hill, Van Santen, Steadman & Simpson

[57] ABSTRACT

A motor-vehicle window curtain is fastened to gliders which are longitudinally displaceable along upper and lower profile rails by means of two displacement wires which extend through the gliders. For opening and closing the curtain, the displacement wires are wound on and off in separate conically formed winding grooves which are arranged coaxially with one another on a motor-driven rotor. The ratio of the radii of the winding grooves is equal to the ratio of the necessary displacement lengths of the respective wires so that synchronous displacement of the curtain along the upper and lower rails is ensured and jamming is avoided.

17 Claims, 3 Drawing Figures

MOTOR-VEHICLE WINDOW CURTAIN OPENING AND CLOSING MECHANISM

This invention relates to a motor-vehicle window curtain opening and closing mechanism comprising a motor-vehicle window curtain which is guided with the aid of gliders located in or on upper and lower profile rails extending along the top and the bottom of the window and is displaceable by means of at least one motor-driven displacement element extending along one of the profile rails, in which respect the displacement element acts on an entrainment bar or tube held along the front edge of the curtain and consists of a stiff-elastic displacement wire which is capable of being wound up onto a rotor.

Such a mechanism is disclosed in German Patent Application No. P 34 07 664.6, and is operable to displace a curtain on a window pane of a motor vehicle parallel to the pane. However, if the edges of the pane are severely curved, which is so often the case for a rear window of a motor vehicle, such that there is a considerable difference in the displacement length between the upper and the lower profile rail, distortions can occur. Such distortions may be overcome by increased motor power, but they may in a region of severe curvature lead to jamming of the gliders and a malfunction of the mechanism.

The object of the invention is, therefore, to provide a mechanism for the motor-driven opening and closing of motor-vehicle window curtains whereby a pushing or a pulling force can be exerted along both upper and lower profile rails whilst even in the case of different displacement lengths synchronous displacement of the curtain along the upper and lower profile rails is guaranteed.

In accordance with the invention, this object is achieved in that there are two displacement wires extending respectively along the upper and lower profile rails, in that each glider is formed with a foot and the displacement wires extend respectively through a bore in the foot of each relevent glider, in that the rotor for the displacement wires has two separate winding grooves in which the motor-side ends of the respective displacement wires are secured, which grooves are arranged coaxially with one another and in each case extend inwardly relative to the axis of rotation of the rotor along a conically formed surface, and in that the ratio of the radii of the respective winding grooves is equal to the ratio of the displacement lengths of the upper and lower displacement wires.

As a result of these provisions in accordance with the invention, and particularly through the ratio of the radii of the winding grooves, synchronism of the displacement wires with respect to their initial positions and their end positions is ensured. Indeed, as a consequence of the ratio of the radii of the winding grooves, the different displacement lengths of the wires are run through with correspondingly different displacement speeds.

For jam-free guidance of the displacement wires into the winding grooves a fixed guide disc is advantageously associated with the rotor to direct the displacement wires tangentially into the winding grooves. The introduction of the wires into the winding grooves can be further improved if the guide disc has guide noses which engage into the winding grooves and impart a downwardly-directed force component to the drawn in displacement wires to displace downwards the displacement wire packed into the winding grooves. This downwards displacement of the displacement wire which is packed or wound into the grooves (hereinafter referred to as the windings) is facilitated in that relative to the axis of rotation of the rotor each winding groove inclines inwardly along a conically formed surface, so that in each case only the first introduced coil of the winding butts against the surrounding conical surface, and each further winding lifts off somewhat from the surrounding conical surface. In this way, the winding can easily be shifted further into the winding groove upon the winding up of the displacement wire.

In order to reliably transmit pushing and pulling forces to the entrainment bar or tube located at the front edge of the curtain, the displacement wires are preferably each guided, in the region between the profile rail and the guide, in a Bowden cable sleeve.

To reduce the friction of each displacement in its respective Bowden cable sleeve, a sliding tube made of plastics material is preferably slipped onto each displacement wire in the region of its Bowden cable sleeve and its winding groove. This sliding tube is larger in diameter than half the width of each winding groove, so that the sliding tube also ensures that upon the insertion of each displacement wire into its winding groove a satisfactory single layer winding is formed.

In order to ensure complete closing of the curtains, the Bowden cable sleeves are preferably longer than the greatest displacement length of their respective wires which is needed for complete closure of the curtain.

In order to avoid over-rotation of the rotor at the end of the curtain closing procedure, the last coil of the displacement wire winding, which indicates the end point for the run-out of the curtain, is provided with a stop which stops the rotor. This stop can be designed in the form of a thickening of the sliding tube which, in the fully-closed state of the curtain, will butt against that end of the Bowden cable sleeve which is mounted on the guide disc so that the rotor, if driven with a friction coupling, or, in the case of direct drive, the motor, is stopped. Preferably the stop also acts on a motor control switch which switches the motor off.

Since a comparatively thin stiff-elastic wire is used for the displacement wire and only short sections of this wire are guided in the gliders, the bore in the foot of each glider is preferably arranged eccentrically towards the outside of the profile rail interior, i.e. closely adjacent the internal surface of the rail which is in the form of a slotted channel. As a result of this eccentric arrangement, upon closing of the curtain, a shear effect or pushing effect is transmitted by way of the displacement wire, buckling of the displacement wire by the profile rail itself is prevented, since the buckling displacement wire is applied laterally to the inner surface of the rail and cannot veer off upwardly. Thus reliable guidance is ensured and at the same time it is also possible to make do with a very thin displacement wire.

Finally, where the rotor is positioned at the bottom of the window, the Bowden cable sleeve extending to the upper profile rail conveniently serves for stiffening the inner curtain edge.

The invention will be described further, by way of example, with reference to the accompanying drawings, in which.

Figure 1:
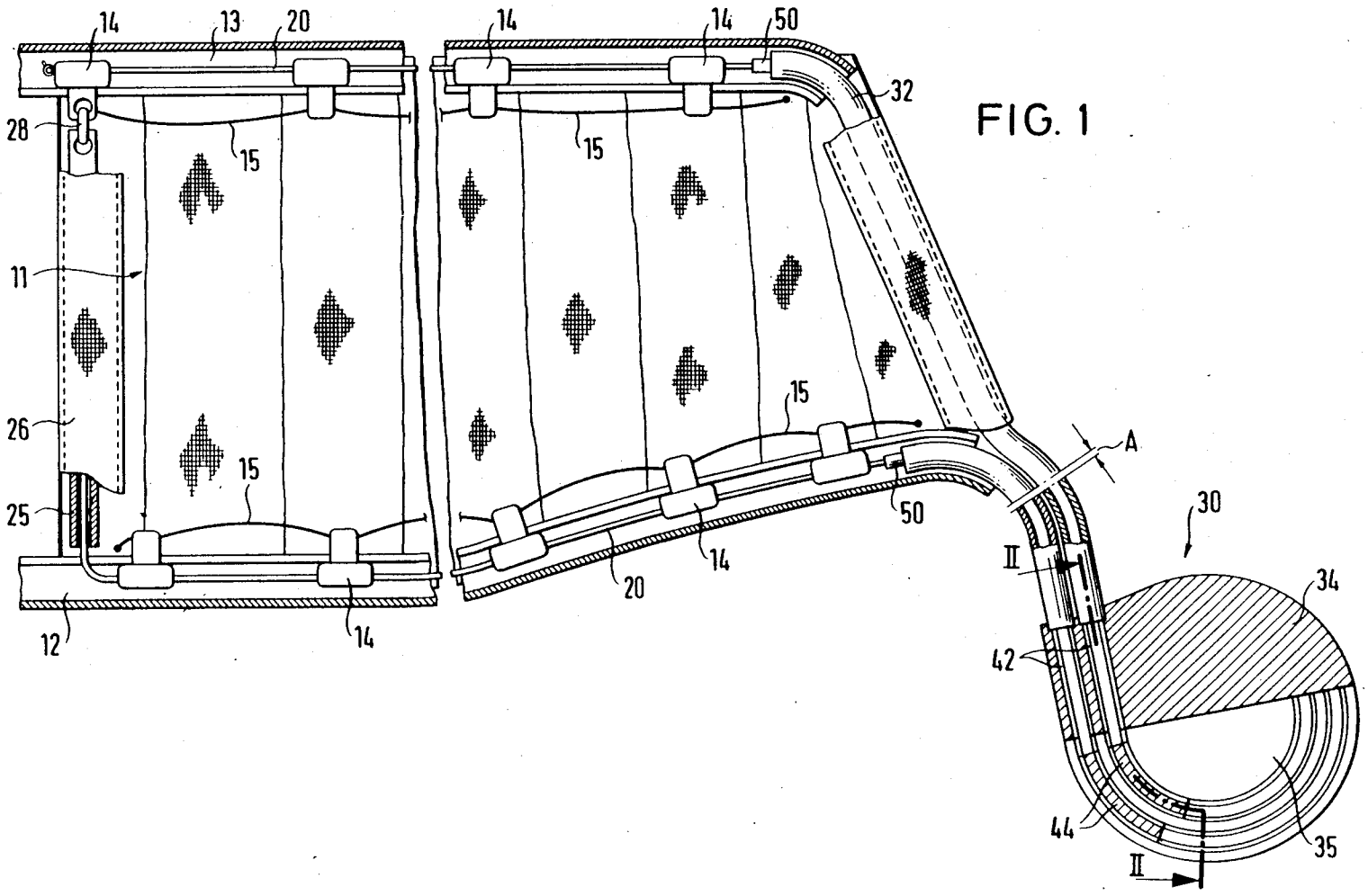
FIG. 1 is a schematic partial view of one embodiment of the motor-vehicle window curtain opening and closing mechanism of the invention as applied to a motor-vehicle rear window.

Shown schematically in FIG. 1 is a rear window arrangement for a motor vehicle which is provided, on the inside, with a curtain 11 suspended by gliders 14 which are guided along a lower profile rail 12 and an upper profile rail 13. The lower and upper profile rails 12, 13 are appropriately differently curved in accordance with the course of the window. As a result of the different curvature and, in this case, as is usual, the longer lower edge of the rear window, the gliders 14 located in the upper and lower profile rails 12 and 13 have displacement paths of different length when the curtain 11 is displaced from a fully opened state into a fully closed state. The necessary relatively severe curvature of the profile rails 12 and 13 and different displacement lengths at the top and bottom of the window frequently leads in the case of known displacement devices to the gliders getting stuck. This usually occurs towards the end of the closing procedure, so that the curtain 11 does not close completely.

Figure 3:
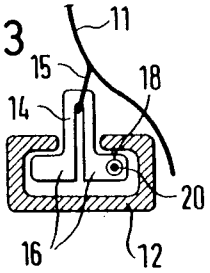
FIG. 3 is a through a profile rail with a glider guided therein.

Along the upper and lower edge of the curtain 11 there is a fastening tape 15 to which the gliders 14 are attached. This attachment of the gliders 14 to the curtain 11 is shown in FIG. 3. Each glider 14 is U-shaped and is provided with a two-part foot 16 running in the relevant profile rail 12, 13. A bore 18, through which a displacement wire 20 extends, is situated eccentrically in the foot 16 at each glider 14.

There are two displacement wires 20, along the top and bottom of the curtain 11, respectively associated with the upper and lower profile rails 12, 13. Each displacement wire 20 preferably consists of a stiff-elastic steel wire of, for example, 0.8 to 1 mm diameter, which is freely displaceable in the longitudinal direction in the bore 18 of each glider 14. In the closure direction of the curtain 11 and after the first glider 14, the wire 20 associated with the lower rail 12 is bent at right angles in the direction of the window pane so that it acts in this region as entrainment bar for an entrainment tube 25. This entrainment tube 25 is placed into a hem 26 provided along the front edge of the curtain 11 so that the pulling or pushing force respectively necessary for the opening and closing of the curtain 11 can act on the curtain 11 by way of the entrainment 25 tube.

The wire 20 associated with the upper rail 13 can be similarly arranged. However, in the embodiment shown in FIG. 1, the upper displacement wire 20 is fastened to the front glider 14, to which the entrainment tube 25 is fastened by means of a ring 28.

Usually when the curtain 11 is situated on a rear window, the lower rail 12 is mounted on an underlying base such as a rack or floor and the curtain 11 usually consists of two halves, which clsoe from the side towards the centre. Accordingly, one winding motor 30 is needed for each curtain half, each motor 30 preferably being mounted on the underside of the underlying base.

The displacement wires 20 are guided from the upper profile rail 13 and from the lower profile rail 12 through respective Bowden cable sleeves 32 as far as the winding motor 30. In this respect, the Bowden cable sleeve 32 extending to the upper profile rail 13 can be conducted through a hem on the fixed side of the curtain 11, as shown in FIG. 1, in order to stiffen this region.

Figure 2:
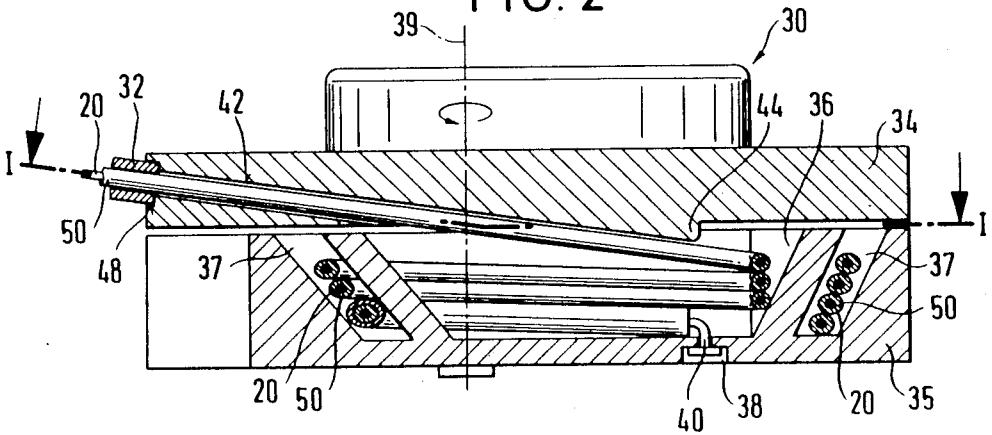
FIG. 2 is a along the line II—II of FIG. 1.

As shown in FIGS. 1 and 2, associated with the winding motor 30 is a guide disc 34 through which a shaft extends to a rotor 35, in order to rotate the latter in accordance with the control of the motor 30. Formed in the rotor 35 are coaxial inner and outer winding grooves 36, 37. Relative to the axis of rotation 39 of the rotor 35, these grooves 36, 37 each extend inwardly along a conically formed surface. In this respect, the outer winding grooves 37 is associated with the displacement wire 20 having the longer displacement length and the inner winding groove 36 is associated with the displacement wire 20 having the shorter displacement length, in which respect the ratio of the radii at the mean diameters of the respective winding grooves is equal to the ratio of the displacement lengths of the respective displacement wires 20. Since the displacement lengths are determined by the length of the window side and the associated arrangement of the profile rails 12, 13, the diameter for the respective grooves 36 and 37 can be calculated in a simple manner from the mean circumference of the winding grooves. The depth of each winding groove 36 and 37 depends on the number of winding coils which are necessary in order to accommodate the entire displacement length of the displacement wire 20 in the groove.

The motor-side end of each displacement wire 20 is fastened to the base of the associated winding groove 36 and 37. To accomplish this in a simple manner a bore 38 is provided extending from the base of the winding groove 36 and 37 towards the outside and the end 40 of the displacement wire 20 is conducted through this bore 38 and fastened in the base region by rivetting, jamming or the like. The guide disc 34 situated above the rotor 35 is provided with bores 42 which extend tangentially towards the winding grooves 36 and 37 from above and open out tangentially into the winding grooves 36 and 37. Where the aforesaid bores 42 open out, guide noses 44 are provided on the guide disc 34, which guide noses 44 are curved in accordance with the course of the winding grooves 36 and 37 and project into these. These guide noses 44 have a guide plane aligned with the bores 42.

The motor-side end of each Bowden cable sleeve 32 is inserted into a respective recess 48 in the guide disc 34 and thereby supported. In the region of the respective Bowden cable sleeve 32, a sliding tube 50 is slipped onto each displacement wire 20, which tube 50 extends as far as the motor-side end of the displacement wire 20. This sliding tube 50 has an inside diameter large enough to receive the displacement wire 20 and its outside diameter is adapted to the inside diameter of the Bowden cable sleeve 32, so that it is longitudinally displaceable in the Bowden cable sleeve 32 together with the displacement wire 20. The outside diameter of the sliding tube 50 amounts, for example, in the case of a functional test model, to 1.5 up to 2 mm. The width of the winding groove 36 or 37 is preferably smaller than 1.8 to 1.9 times the outside diameter of the sliding tube 50 so that, upon the winding up of the displacement wire 20 provided with the sliding tube 50, a single-layer winding is ensured and individual coils cannot be superposed in the winding groove 36 or 37.

Since the gliders 14 are intended to be freely displaceable on the displacement wire 20, the sliding tube 50 may extend at a maximum, with the curtain 11 closed, as far as the curtain-side of the Bowden cable sleeve 32. The lengths of the sliding tube 50 and of the Bowden cable sleeve 32 must be co-ordinated to one another in such a way that, with the curtain 11 fully opened, the sliding tube 50 drawn back in the Bowden cable sleeve always still remains with its foremost end in the Bowden cable sleeve. Thus a simple and reliable running-order is ensured even in the case of a comparatively severe curvature of the Bowden cable sleeve 32.

The use of the sliding tube 50 is not absolutely necessary for the operation of the mechanism of the invention. For example, if the displacement wire 20 has a fairly large diameter and/or if the preferred length of the Bowden cable sleeve 32 is not possible by reason of the spatial conditions, the mechanism will work without a sliding tube 50, in which respect of course the radii of curvature of the Bowden cable sleeve 32 are to be greater than upon use of a sliding tube 50. If no sliding tube 50 is used, the width of the winding groove 36 or 37 should be adapted to the diameter of the displacement wire 20, in order to ensure a one-layer winding, However, it has been shown that, when a sufficiently stiff displacement wire 20 is used, the width of the winding groove 36 or 37 can be greater than twice the wire diameter, without the formation of a one-layer winding upon the opening of the curtain 18 and 21 being impaired.

The motor of an extensible antenna for motor vehicles can be used as the winding motor 30 since the power thereof is sufficient to actuate the curtain. The guide disc 34 is then fastened to the antenna motor while the rotor 30 35 is fastened to the winding shaft of the antenna motor 30. The usual circuit for control of an antenna motor 30 can be used to control the winding motor, and in particular the switch-off for the antenna motor can be used in the end positions of the curtain 11. However, so that, upon the closing of the curtain 11, the motor 30 is switched off immediately the closure position is reached, an additional switch-off device (not shown) can be provided, which is actuated after the run out of a specific length of the displacement wire 20. For example, on the displacement wire 20 or on the sliding tube 50 a stop (not shown) may be situated which, as soon as it comes into the region of the guide disc 34 actuates an end-position switch (not shown) fastened to the guide disc 34. Control circuits of this kind are generally known and need no further explanation. Such an additional end-position switch is particularly desirable when a comparatively thin displacement wire 20 is used which would easily be deformed upon sustained thrust between the gliders 14 in the closure position of the curtain 11 and could, upon severe bulging, possibly emerge through the slot of the profile rail 12 or 13. Since, however, the displacement wire 20 extends through a bore 18 in the foot 18 of the glider 14 which is situated eccentrically and on the outside of the profile rail 12 or 13 curvature, any displacement wire 20 bulging under pressure is initially applied to the inside of the profile rail 12 or 13 and is guided there. This guidance is sufficient for satisfactory operation, so long as the curtain 11 is displaced as a result of a pressure force introduced through the displacement wire 20. This eccentric guidance of the displacement wire 20 in the profile rail 12 or 13 makes it possible to reduce the displacement wire to a very small diameter, which means, in turn, that the size of the guide disc 34 and of the rotor 35 can be reduced. In practice, a displacement wire of 0.8 mm $\phi$ has been used and satisfactory functioning been achieved.

Through the use of winding grooves 36 and 37, extending around a conically formed surface, of a width adapted to the displacement wire 20 and furthermore through the oblique tangential introduction of the displacement wire 20 into the winding groove 36 and 37 by means of the guide disc 34, single-layer winding is achieved which can easily be displaced downwards by the force component introduced from the guide nose 44 onto the displacement wire 20. This is the case because as the individual windings are displaced further downwards, they butt against the conical surface with less pressure and thus facilitate the downward displacement of the winding. In the case of conventional types of motor vehicle even with large rear window panes the diameter of the rotor 35 and of the guide disc 34 can be kept comparatively small if 3 to 5 winding coils are provided for in the windings groove 36 and 37. This can easily be calculated from the following equation $$L = n \cdot 2\pi r$$

in which L is the displacement length, n is the number of windings and r is the radius of the mean diameter of the winding groove.

The device in accordance with the invention is very well suited not only for the actuation of curtains 11 on rear windows, but also on side windows, in which respect, in the interest of uniform parts and a reduction in the production costs, it may be desirable to maintain the dimensions of the rotor 35 and of the guide disc 34 unchanged and merely to vary the position of the stop for the endposition switch in the curtain closure position in accordance with the displacement length of the curtain 11. Such an end stop can, for example, be a piece of a Bowden cable sleeve 32 additionally slipped onto the motor-side end of the displacement wire 20, the front end of this Bowden cable sleeve 32 on the curtain side then forms the stop and actuates an end-position switch which is fastened in the region of the tangentially extending bore 42 of the guide disc 34. In this way the displacement length can be adapted very easily to the respective instance of use.

We claim:

1. A motor-vehicle window curtain opening and closing mechanism for use on a motor-vehicle window, comprising:

a motor-vehicle window curtain for selectively blocking the motor-vehicle window;

upper and lower profile rails extending respectively along the top and along the bottom of the motor-vehicle window;

gliders movable along said upper and lower profile rails and connected to guide said window curtains;

at least one motor-driven displacement element extending along one of said profile rails and including a stiff-elastic displacement wire capable of being wound on a rotor;

an entrainment bar held along the front edge of said window curtain;

said displacement element including two of said displacement wires extending respectively along said upper and lower profile rails to define displacement lengths, each of said displacement wires having motor-side ends;

each of said gliders being formed with a foot having a bore;

said displacement wires extending respectively through said bore in said foot of each corresponding glider;

a rotor for said displacement wires having two separate winding grooves in which said motor-side ends of respective ones of said displacement wires are secured, said grooves being arranged coaxially with one another and each of said grooves extending inwardly relative to the axis of rotation of said rotor along a conically formed surface, and the ratio of the radii of respective ones of said winding grooves being equal to the ratio of the displacement lengths of said upper and lower displacement wires.

2. A motor-vehicle window curtain opening and closing mechanism as claimed in claim 1, further comprising:

a fixed guide disc associated with said rotor to direct said displacement wires tangentially into said respective winding grooves.

3. A motor-vehicle window curtain opening and closing mechanism as claimed in claim 2, wherein said guide disc includes guide noses engaging into respective ones of said winding grooves.

4. A motor-vehicle window curtain opening and closing mechanism as claimed in claim 2, further comprising:

a Bowden cable sleeve provided in the regions between said profile rails and said guide disc to guide each of said displacement wires.

5. A motor-vehicle window curtain opening and closing mechanism as claimed in claim 4, wherein each of said Bowden cable sleeves is longer than the greatest displacement length of a respective one of said displacement wires.

6. A motor-vehicle window curtain opening and closing mechanism as claimed in claim 4, further comprising:

a sliding tube of plastics material slipped onto each of said displacement wires in the region of a respective one of said Bowden cable sleeves and a respective one of said winding grooves.

7. A motor-vehicle curtain opening and closing mechanism as claimed in claim 1, further comprising:

a stop provided at a last coil of said displacement wire in said winding groove to indicate the end point for the run-out of said window curtain to its closed condition and to stop said rotor.

8. A motor-vehicle window curtain opening and closing mechanism as claimed in claim 1, wherein said bore in said foot of each of said gliders is disposed eccentrically towards the outside of said respective profile rail.

9. A motor-vehicle window curtain opening and closing mechanism as claimed in claim 4, wherein said Bowden cable sleeve extending to said upper profile rail serves to stiffen an inner edge of said window curtain.

10. A motor-vehicle window curtain opening and closing mechanism as claimed in claim 1, further comprising:

an entrainment tube having a front end of at least one of said displacement wires bent aside at right angles and extending into said entrainment tube.

11. An apparatus for opening and closing a curtain in a vehicle window, comprising:

first and second profile rails extending along opposing sides of the vehicle window;

first and second displacement wires slidably movable within respective ones of said first and second profile rails;

a plurality of gliders along both said first and second displacement wires, said gliders being slidably movable along said profile rails and connected to hold said curtain;

a winding motor connected for selective operation;

a rotor connected for rotation by said winding motor and having inner and outer winding grooves for accepting respective ones of said first and second displacement wires; and means for guiding said first and second displacement wires into said inner and outer widing grooves;

whereby operation of said motor to rotate said rotor in a first direction opens said curtain and operation of said motor to rotate said rotor in a second direction closes said curtain.

12. An apparatus as claimed in claim 11, wherein said first and second displacement wires are movable over mutually different displacement lengths, and said inner and outer winding grooves are formed on mutually different radii.

13. An apparatus as claimed in claim 12, wherein the ratio of the radii of said inner and outer winding grooves is substantially equal to the ratio of the displacement lengths for said first and second displacement wires.

14. An apparatus as claimed in claim 11, wherein each of said glides includes a foot disposed within one of said profile rails, an opening extending through said foot having one of said displacement wires slidably extending through said opening.

15. An apparatus as claimed in claim 14, wherein said foot of each of said gliders is in two parts connected by a U-shaped portion, said U-shaped portion being connected to said curtain.

16. An apparatus as claimed in claim 11, further comprising:

a guide disc mounted adjacent said rotor and having first and second openings extending tangentially toward respective ones of said inner and outer winding grooves, said first and second displacement wires extending through respective ones of said first and second openings, guide noses on said guide disc aligned with said first and second openings and projecting into said inner and outer winding grooves.

17. A curtain opening and closing mechanism for a curtain supported by gliders in rails on opposite sides of said curtain, comprising:

first and second displacement wires extending along respective ones of said rails and affixed to at least one of said gliders;

a rotor having coaxial inner and outer winding grooves on respective conical surfaces for receiving respective ones of said first and second displacement wires; and means for selectively rotating said rotor to open and close said curtain.

* * * * *